US005792011A

United States Patent [19]

Kuebler

[11] Patent Number: 5,792,011

[45] Date of Patent: Aug. 11, 1998

[54] VIBRATION DAMPNER FOR SPORTS RACKET

[76] Inventor: Siegfried Kuebler, Zum Saibling 25, 88662 Uberlingen, Germany

[21] Appl. No.: 900,052

[22] Filed: Jul. 24, 1997

Related U.S. Application Data

[63] Continuation of Ser. No. 631,672, Apr. 9, 1996, abandoned.

[30] Foreign Application Priority Data

Apr. 15, 1995 [DE] Germany ..... 195 14 234.9
May 5, 1995 [DE] Germany ..... 195 16 501.2

[51] Int. Cl.[6] ..... A63B 59/06

[52] U.S. Cl. ..... 473/520; 473/437

[58] Field of Search ..... 473/520, 521, 473/171, 463, 437, 524, 112, 115

[56] References Cited

U.S. PATENT DOCUMENTS

| | | | |
|---|---|---|---|
| 4,071,239 | 1/1978 | Ferguson | 473/425 |
| 5,098,098 | 3/1992 | Petralia | 273/73 R |

FOREIGN PATENT DOCUMENTS

| | | | |
|---|---|---|---|
| 208639A | 1/1987 | European Pat. Off. | 473/171 |
| 261994 | 3/1988 | European Pat. Off. | 273/73 R |
| 261994A | 3/1988 | European Pat. Off. | 473/171 |
| 3123690 | 3/1983 | Germany | 273/73 R |
| 3329150 | 2/1985 | Germany | 273/73 R |
| 4124958 | 1/1993 | Germany | 473/171 |

*Primary Examiner*—Theatrice Brown

[57] ABSTRACT

Associated with a racket for tennis or the like games having a frame for receiving stringing (18, 19) and comprising a profile bar, and a handle end, is at least one receiving space for granules or the like mass particles (34), in particular lead shot, wherein the receiving space (32) is part of an insert (30) which is fitted into a stringing mesh of the stringing (18, 19).

7 Claims, 1 Drawing Sheet

VIBRATION DAMPNER FOR SPORTS RACKET

This application is a continuation of application Ser. No. 08/631,632, filed Apr. 9, 1996 (abandoned).

The invention concerns a racket for tennis or the like games, having a frame for receiving stringing, comprising a profile bar, as well as a handle end, wherein associated with the racket are receiving spaces for granules or the like mass particles of a solid medium. The invention also concerns an insert for a tennis racket.

Rackets of that kind provide that adaptation to the physical factors of a player is achieved in particular by virtue of the choice of the racket grip in terms of shape and weight. As that method has been found to be difficult and—in particular in regard to stockeeping—expensive, the applicant of U.S. Pat. No. 4,182,512 sought a way of being able to easily adapt the racket to the strength of the individual player and to increase the internal damping of the racket frame so that as far as possible vibrations are already brought under control at the place at which they are generated.

The construction in that prior invention provided arranging on the racket a box-like receptacle in which a granule-like medium—preferably of high specific weight such as buckshot—is disposed with play, the granule-like medium being movable limitedly at least transversely to the axis of the racket. This addition of granule-like medium permits the racket to be adapted to the wishes of the individual player. In addition, the change in the conditions in respect of energy on a moving racket, due to additional weighting particles which move in a relatively differentiated fashion, results in a considerably better hitting procedure and performance; in comparison with a conventional racket, with the force applied being the same, the weight of hitting is considerably increased and the thrust force of an impinging ball on the racket is considerably braked without a large amount of force being applied.

Cartridges or similar receptacles which are fixed to the racket frame are proposed in accordance with U.S. Pat. No. 4,182,512 for the granule-like medium on the racket frame, or the per se known heart portion of the racket is of a hollow construction and filled with the granule-like medium.

The introduction of granular, dry and pourable loose materials comprising sand, steel or lead balls or shot into the hollow profile in the case of metal rackets, into holes which are drilled in the frame or into cartridges attached thereto, provides a considerable wide-band damping effect.

An arrangement in individual juxtaposed chambers enhances the effect. The non-linearity of the damping effect is among the substantial advantages of the damping mechanism if the acceleration due to gravity is overcome, as when a ball is hit. More specifically the damping effect is available precisely when it is needed, at large amplitudes or high levels of acceleration.

In consideration of those factors the inventor set himself the aim of permitting simple application of the granule-like medium and increasing the damping properties.

That object is attained by the teaching of the independent claim; the appendant claims set forth advantageous embodiments.

In accordance with the invention at least one receiving space for the mass particles or the granules is arranged in the stringing; preferably, a knob-like insert in which the granules are disposed with play is releasably arranged in a stringing mesh which is defined by the mutually crossing strings. Protection is claimed separately for that insert with receiving space.

So-called vibration dampers comprising a solid-rubber shaped body which can be clamped into a stringing mesh have long been known. Here the inventor uses same in a delightful manner for the introduction of the granules, preferably lead shot.

Further advantages, features and details of the invention will be apparent from the following description of preferred embodiments and with reference to the diagrammatic drawing in which.

Figure 1:
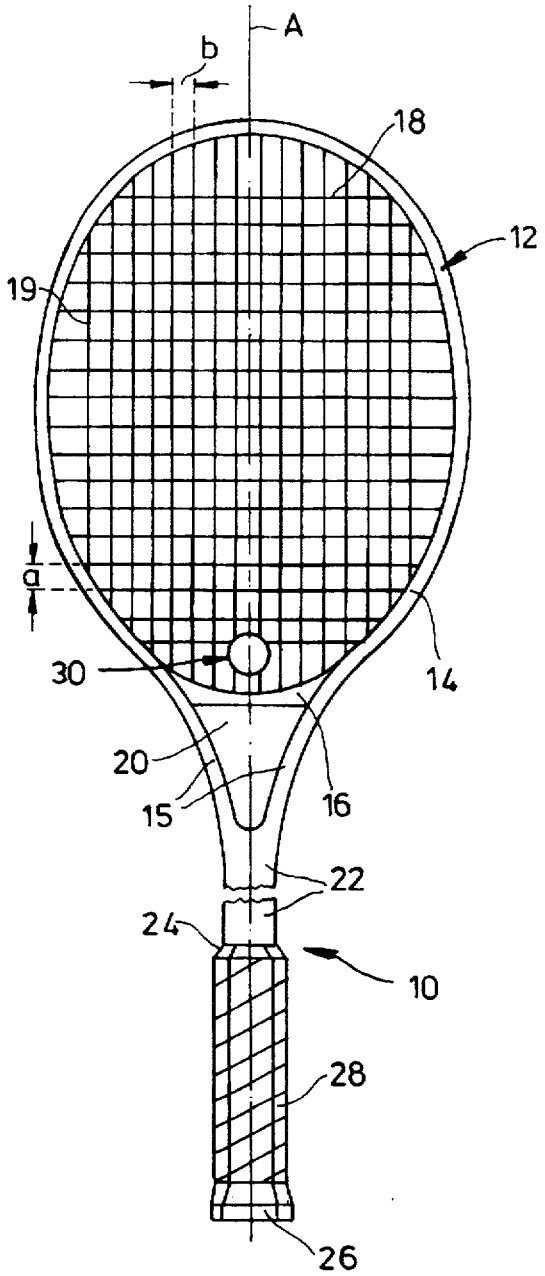
FIG. 1 is a plan view of a tennis racket with frame, heart zone and handle.
Figure 2:
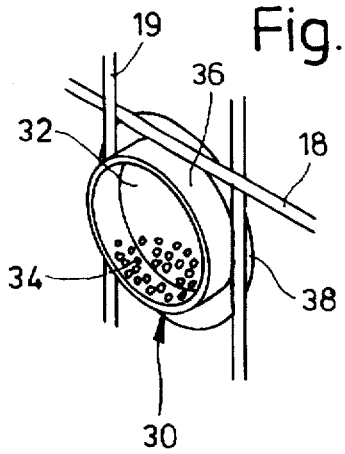
FIG. 2 is a sectional perspective view of an enlarged detail from FIG. 1, FIGS. 3 and 4 are diametral sections through different embodiments of the detail from FIG. 2.
Figure 3:
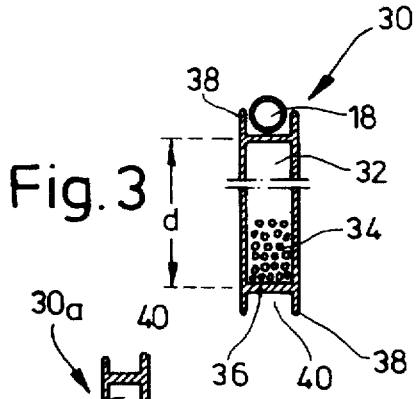

A tennis racket 10 has a frame 12 comprising a profile bar 14 which is bent approximately to an oval shape, and a frame crosspiece 16 which completes that oval; arranged in the oval of the frame 12 is stringing comprising mutually crossing transverse and longitudinal strings 18 and 19 which pass through the frame 12 and the frame crosspiece 16. The strings 18 and 19 form stringing meshes of a length a of for example 15 mm and a width b of approximately 12 mm.

Outside the frame 12 the two end portions 15 of the profile bar 14 laterally define a free area 20, which is triangular in plan view, of a heart zone which has the end portions 15 and the frame crosspiece 16. At the ends of the heart zone which are remote from the frame, the end portions 15 merge on the axis A of the racket into a handle neck 22 which is adjoined by a handle 24 with a handle tape winding 28 that covers over a handle cap 26.

A knob-like or button-like insert 30 can be seen in the stringing in FIG. 1.

The insert 30 has a hollow space or cavity 32 for receiving a granule material 34 which is surrounded by a limitedly elastic ring 36 whose diameter d approximately corresponds to the stringing mesh dimension a or b. The ring 36 is integrally connected to two end discs 38 which project radially beyond it; the peripheral groove 40 which is laterally delimited by the discs 38 accommodates two pairs of strings 18, 19 which are tangential to the ring 36.

Figure 4:
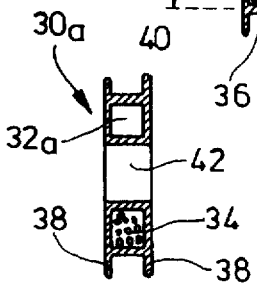
Figure 5:
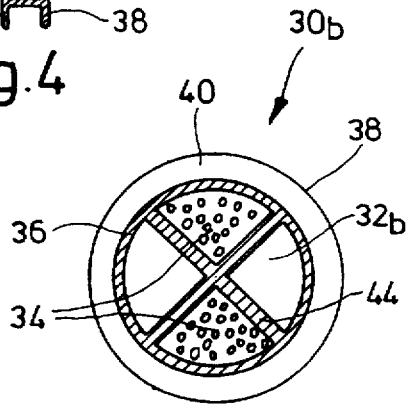
FIG. 5 is a view in cross-section through a further embodiment.

The limitedly elastic insert 30 may be of different configurations. Thus for example FIG. 4 shows a hollow ring $30_a$ with an annular space $32_a$ around a central opening 42, FIG. 5 shows a ring 36 which has a plurality of chambers $32_b$ and through which pass diametral walls 44. Only some of the chambers $32_b$ may be filled with the granules. If at least one end disc 38 is releasable from the ring 36, the granules 34 can also be removed or replaced.

I claim:

1. A damping device for use with a sports racket comprising a body portion having a central case and a peripheral groove dimensioned to receive the strings of a sports racket, the central case having a receiving space central case containing a freely moving mass of a granular, dry and pourable loose material, the granular material being selected from the class comprising small shot, lead balls, steel balls, and sand, the central case including a peripheral wall which delimits the receiving space, an end disc which extends radially beyond the peripheral wall, the end disc and the peripheral wall forming the peripheral groove for the strings, wherein the central case includes an internal wall which is surrounded by the peripheral wall and which divides the receiving space into chambers, and wherein said end disc is releasable from said peripheral wall for removing or replacing said granular material in said chambers.

2. The damping device of claim 1 wherein at least one of said chambers is filled with the freely moving mass of granular material.

3. The damping device of claim 1 in which the peripheral wall is generally cylindrical.

4. The damping device of claim 1 in which the receiving space is generally cylindrical.

5. The damping device of claim 4 in which the body portion is formed at least partially from flexible material.

6. The damping device of claim 1 in which the body portion is formed at least partially from flexible material.

7. The damping device of claim 1 in combination with a sports racket having a plurality of crossing strings, a handle, a throat, and a bow mounting said strings, wherein said damping device is held in clamping relationship between two mutually crossing pairs of parallel strings.

* * * * *